United States Patent [19]

Dernedde et al.

[11] Patent Number: 4,720,248

[45] Date of Patent: Jan. 19, 1988

[54] THERMAL BARRIER FOR SUBMERSIBLE PUMP AND MOTOR ASSEMBLIES

[75] Inventors: Robert Dernedde, Frankenthal; Hans-Joachim Franke, Grünstadt; Peter Havekost, Bobenheim-Roxheim; Christian Klepp, Frankenthal, all of Fed. Rep. of Germany

[73] Assignee: Klein, Schanzlin & Becker Aktiengesellschaft, Frankenthal, Fed. Rep. of Germany

[21] Appl. No.: 604,407

[22] Filed: Apr. 27, 1984

Related U.S. Application Data

[63] Continuation of Ser. No. 258,806, Apr. 29, 1981, abandoned.

[30] Foreign Application Priority Data

Apr. 30, 1980 [DE] Fed. Rep. of Germany ..... 3016681

[51] Int. Cl.[4] ..... F04B 17/00; F04B 35/00; F04B 39/02; F04B 39/06

[52] U.S. Cl. ..... 417/373

[58] Field of Search ..... 417/373; 277/22; 310/64, 65

[56] References Cited

U.S. PATENT DOCUMENTS 1,873,267 8/1932 Bigelow et al. ..... 277/22
2,737,120 3/1956 Ivanoff et al. ..... 417/373 X
3,947,154 3/1976 Klepp et al. ..... 417/373
4,239,462 12/1980 Dach et al. ..... 417/373

*Primary Examiner*—Carlton R. Croyle
*Assistant Examiner*—Donald E. Stout
*Attorney, Agent, or Firm*—Peter K. Kontler

[57] ABSTRACT

A thermal barrier which is interposed between the casing of a pump and the housing of a motor has a first section which resembles a spool and includes a first flange sealingly connected to the casing, a second flange sealingly connected to the housing and a hollow cylindrical core spacedly surrounding the pump shaft between the two flanges. The first section serves primarily or exclusively to establish a seal between the pump casing and the motor housing, and the thermal barrier has a second section which takes up stresses and further serves as a heat insulating and/or heat dissipating device. The second section is removably installed in the space between the two flanges of the first section and spacedly surrounds the core. The second section may be constituted by hollow cylindrical walls, one or more stacks of washers or rings, one or more annuli of parallel tubes, bars, rods, ribs or a combination of such elements. The original second section can be replaced with another second section exhibiting different heat-insulating properties and/or a different resistance to mechanical stresses when the conditions under which the pump and motor assembly is used change sufficiently to warrant replacement of the second section.

26 Claims, 8 Drawing Figures

THERMAL BARRIER FOR SUBMERSIBLE PUMP AND MOTOR ASSEMBLIES

This application is a continuation of application Ser. No. 258,806, filed Apr. 29, 1981, now abandoned.

BACKGROUND OF THE INVENTION

The present invention relates to thermal barriers for use between the pumps and motors of glandless pump and motor assemblies. More particularly, the invention relates to improvements in thermal barriers which can be utilized in submersible pump and motor assemblies for circulation of liquid media which are maintained at elevated pressures and temperatures. Such assemblies are often utilized in fossil fuel power stations as well as in nuclear power plants. For example, a glandless pump and motor assembly can be used to circulate feedwater at a temperature of up to and in excess of 375° C. Moreover, such an assembly is often used as a pressure vessel for supercritical feedwater at a temperature of up to 450° C. and a pressure ranging up to and even in excess of 375 bars.

When a pump and motor assembly is used at temperatures within the aforementioned ranges, it is necessary to shield the motor from excessive temperatures of the liquid which is circulated by the pump. Such function is performed by the thermal barrier which is interposed between the casing of the pump and the housing of the motor and serves to prevent the liquid which flows into the housing of the motor from reaching or remaining at temperatures which could cause damage to the motor. The thermal barrier constitutes a mechanical connector between the pump and the motor as well as a shield for the motor insofar as the temperature of the liquid entering the motor is concerned. In other words, a satisfactory thermal barrier must establish a rigid mechanical connection between the casing of the pump and the housing of the motor which drives the pump shaft, and the thermal barrier must further shield the motor from excessive temperatures by ensuring that the liquid which is permitted to flow from the pump casing into the motor housing is maintained at a temperature which is invariably below a preselected value. Moreover, a satisfactory thermal barrier must act not unlike a rigid coupling between the pump and the motor so as to ensure that the shaft which receives torque from the motor is maintained in an optimum position with reference to the pump casing. The thermal barrier also snields the motor from excessive pressures of the fluid which surrounds the assembly if the latter is used for circulation of feedwater in a nuclear power plant or the like.

In accordance with one of many presently known proposals, the thermal barrier is designed as an elongated neck-like insert between the pump casing and the motor housing so as to provide a long path for the transfer of heat from the hot pump to the cold or cooler motor. On the other hand, U.S. Pat. No. 3,947,154 discloses a relatively short lantern-shaped thermal barrier which is provided with ribs and is cooled by air and/or water. As a rule, the thermal barrier is connected to the pump casing and to tne motor housing by means of tie rods, bolts and/or screws so as to establish and maintain a rigid connection between the pump and the motor.

Relatively long thermal barriers exhibit several serious drawbacks. Thus, the long intermediate portion of the pump shaft (namely, that portion which is surrounded by the relatively long thermal barrier) is likely to vibrate unless the dimensions of the shaft are increased for the express purpose of eliminating or reducing vibration. This entails additional initial costs and contributes to the bulk and weight of the assembly.

The proposal which is disclosed in the aforementioned U.S. Patent exhibits the drawback that the component parts of the thermal barrier are highly complex, and hence expensive, castings or welded components. The cost of the thermal barrier which is disclosed in the U.S. Patent is particularly high if the thermal barrier embodies the liquid cooling feature. Cooling with a liquid entails the development of pronounced pressure peaks in the component parts.

British Pat. No. 869,506 discloses a thermal barrier which consists of welded-together components. This device exhibits the drawbacks that its initial and maintenance costs are extremely high, that its components cannot be readily tested for the presence or absence of defects (especially in the regions of welded seams), and that the connection between the pump and the motor does not exhibit a satisfactory stability.

OBJECTS AND SUMMARY OF THE INVENTION

An object of the invention is to provide a novel and improved thermal barrier which allows for establishment of a rigid connection between the pump and the motor of a glandless pump and motor assembly, which can shield the motor from excessive temperatures and/or pressures, and which is sufficiently versatile to permit the utilization of the assembly for a wide variety of different purposes.

Another object of the invention is to provide a thermal barrier which is assembled of simple components, whose components can be readily tested prior to use as well as after shorter or longer intervals of use, which can be taken apart and reassembled as often as necessary, and which is constructed and assembled in such a way that it can exhibit the necessary mechanical stability as well as the ability to shield the pump from excessive thermal stresses and/or excessive pressures.

A further object of the invention is to provide a thermal barrier which can be used as a superior substitute for presently known thermal barriers in certain existing submersible pump and motor assemblies for circulation of feedwater in power plants or the like.

An additional object of the invention is to provide a thermal barrier which invariably establishes a reliable seal between the pump casing and the motor housing regardless of the pressure of liquid which is circulated by the pump and/or which surrounds the assembly.

A further object of the invention is to provide the thermal barrier with novel and improved means for shielding the motor from excessive thermal stresses.

An ancillary object of the invention is to provide a thermal barrier whose compactness at least matches that of presently known thermal barriers but which is much more effective and much more versatile than conventional thermal barriers.

The invention is embodied in a thermal barrier which is utilized in a glandless circulating pump and motor assembly of the type wherein the casing of the pump is spaced apart from the housing of the motor and the pump shaft extends from the casing, across the space between the casing and the housing, and into the housing. The thermal barrier comprises a first section which is interposed between the pump casing and the motor housing and includes a first portion sealingly secured (e.g., by tie rods, screws, bolts or analogous fasteners) to the casing of the pump, a second portion which is sealingly secured to the motor housing and is spaced apart from the first portion, and a third portion which is sealingly secured to the first and second portions and spacedly surrounds the shaft intermediate the first and second portions. The thermal barrier further comprises a heat-insulating or dissipating and stress-resistant second section which surrounds the third portion and is removably interposed between the first and second portions of the first section. The second section may comprise a single component or a plurality of separable components in the form of composite washers, rings, cylinders, ribs, tubes, bars, rods or the like.

The third portion of the first section may be separably connected with at least one of the first and second portions or it may be integral with the first and/or second portion of the first section. For example, the first section may resemble a reel or spool having two coaxial flanges constituted by the first and second portions and a hollow cylindrical core constituted by the third portion.

The second section may be assembled of an annulus of discrete elongated elements or components in the form of tubes, bars, rods, ribs or the like which spacedly surround the third portion of the first section. The second section may define, either alone or with the first section, one or more chambers which are filled with air, with a body of heat-insulating material or with a gaseous or liquid coolant which is caused to circulate through the chamber or chambers.

The novel features which are considered as characteristic of the invention are set forth in particular in the appended claims. The improved thermal barrier itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
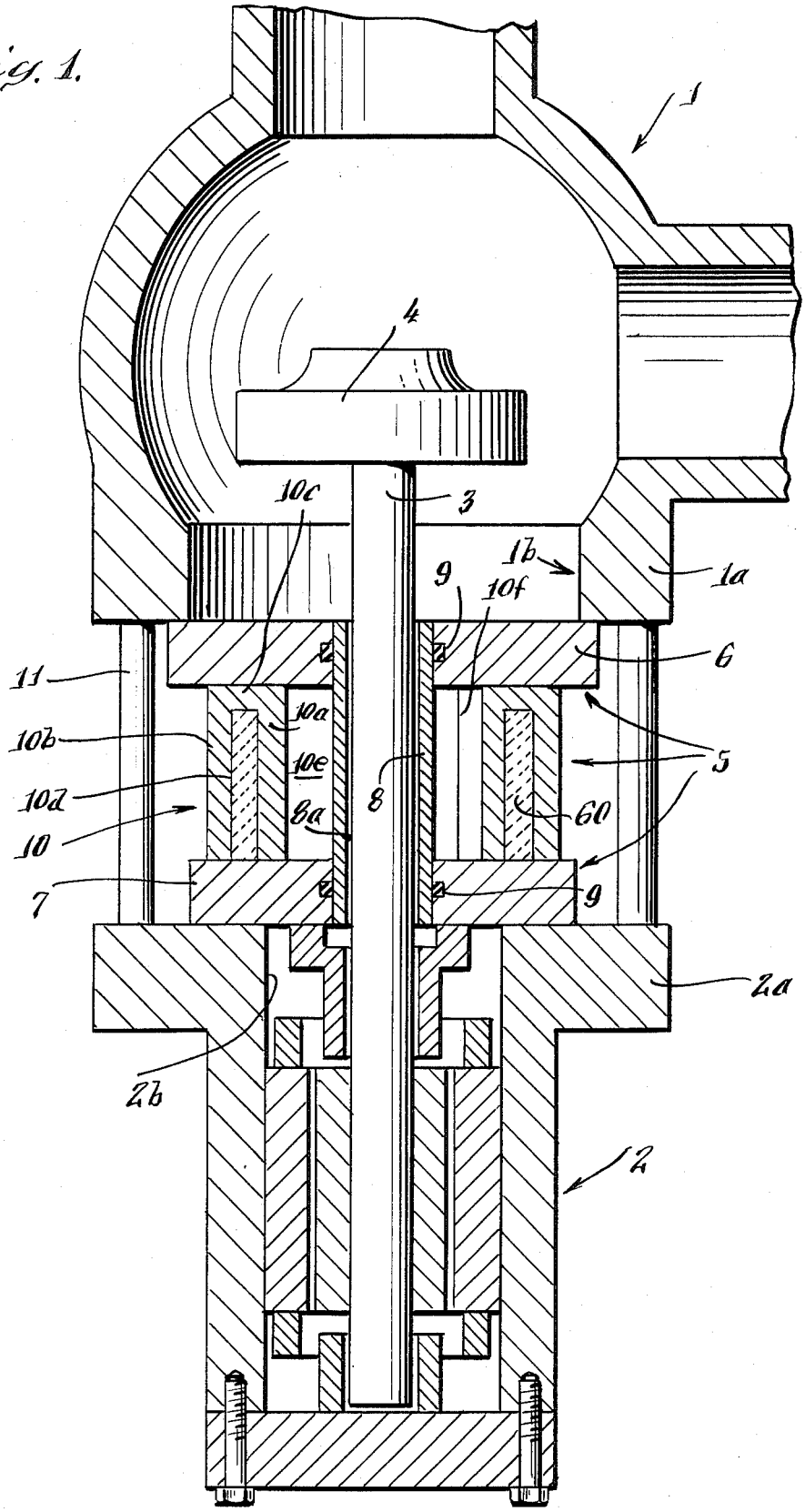
FIG. 1 is a somewhat schematic axial sectional view of a glandless circulating pump and motor assembly wherein the thermal barrier is constructed in accordance with a first embodiment of the invention.

Referring first to FIG. 1, there is shown a submersible glandless pump and motor assembly which includes a centrifugal pump 1, an electric motor 2, and a thermal barrier 5 between the casing or housing 1*a* of the pump 1 and the housing or casing 2*a* of the motor 2. The motor 2 drives a pump shaft 3 which extends substantially vertically upwardly through the thermal barrier 5 and into the casing 1*a* to rotate the impeller 4 of the pump 1.

In accordance with a feature of the invention, the thermal barrier 5 comprises a one-piece or composite first section which resembles a reel or spool and includes two spaced-apart parallel coaxial portions or flanges 6, 7 and a hollow cylindrical portion or core 8 surrounding the adjacent portion of the shaft 3 with a certain amount of clearance as shown at 8*a*. The flange 6 is sealingly secured to the lower end portion of the pump casing 1*a*, and the flange 7 is sealingly secured to the upper end portion of the motor housing 2*a*. The core 8 extends all the way between and its upper and lower end portions are respectively surrounded by the flanges 6 and 7. It will be noted that the upper side of the flange 6 seals the major part of the opening 1*b* in the lower end portion of the pump casing 1*a*, and that the underside of the flange 7 seals the major part of the opening 2*b* in the upper end portion of the pump housing 2*a*. The material and/or dimensions of the core 8 can be and preferably are selected in such a way that the core can withstand only those pressures which prevail in the interior of the casing 1*a* and/or in the interior of the housing 2*a*. In other words, the core 8 need not be able to withstand the very high pressures which often prevail in the region around the pump and motor assembly, especially when the assembly is used for the circulation of a liquid in a nuclear power plant. For example, the core 8 may constitute a thin-walled pipe. This is desirable and advantageous because a thin-walled pipe will transfer relatively low or minimal quantities of heat from the pump 1 to the motor 2 when the assembly is in actual use and is operated to circulate a liquid which is maintained at an elevated temperature, e.g., up to and even in excess of 450° C.

In the embodiment of FIG. 1, the thermal barrier 5 is constructed in such a way that the core 8 is a discrete part whose upper and lower end portions are respectively slipped into the axial openings of the flanges 6 and 7. Such end portions are surrounded by suitable ring-shaped seals 9 which are recessed into internal grooves machined into the flanges 6 and 7. It is clear, however, that the core 8 can be permanently or separably assembled with the flanges 6, 7 in any one of a number of other ways.

The thermal barrier 5 further includes a second section 10 which is disposed between the flanges 6, 7 and spacedly surrounds the core 8. The section 10 serves to take up stresses as well as to prevent the transfer of heat from the surrounding area to the core 8 and shaft 3. In accordance with a feature of the invention, the section 10 is preferably a discrete or independent structural element which abuts against the exposed surfaces of the flanges 6, 7 and spacedly surrounds the core 8. The section 10 can be assembled of two or more pieces, e.g., of two or more arcuate or trough-shaped shells (see the line 10*f* which denotes the abutting surfaces of two neighboring shells) which together form a hollow twin-walled cylinder around the core 8. It is not even necessary to permanently or separably connect the section 10 with the flanges 6, 7, i.e., it is often sufficient to select the axial length of the section 10 in such a way that it fits rather snugly between the flanges 6 and 7 and is held in requisite position as a result of frictional engagement of its end faces with the adjacent surfaces of the flanges. The requisite frictional engagement can be established and maintained by an annulus of tie rods 11 which connect the casing 1*a* with the housing 2*a* and are outwardly adjacent to the peripheral surfaces of the flanges 6 and 7. These tie rods constitute a means for rigidly and directly coupling the casing 1*a* with the housing 2*a*.

An important advantage of the improved heat barrier 5 is that its configuration, dimensions and/or other characteristics can readily conform to the requirements in a given submersible glandless pump and motor assembly with a minimum of cost and with a high degree of accuracy and reliability. Thus, if the circumstances under which the assembly is put to use change, e.g., because the pressure of the surrounding liquid changes, because the temperature of the surrounding liquid changes and/or because the nature (aggressiveness and/or other characteristics) of the surrounding liquid changes, it is merely necessary to replace the second section 10 with a different section which can stand the prevailing thermal, mechanical and/or other stresses with a higher or different degree of reliability than the previously employed section 10. Thus, the tie rods 11 will be loosened or removed when the operators wish to replace the section 10 with a different second section, the different second section inserted between the flanges 6, 7 so that it surrounds the core 8, and the tie rods tightened again so as to ensure that the flanges 6, 7 bear against the respective end faces of the freshly inserted second section 10 whereby the latter retains its position and shields the core 8 from excessive thermal, mechanical and/or other stresses. The section 10 which is shown in FIG. 1 has a substantially U-shaped cross-sectional outline, i.e., it comprises two coaxial cylindrical walls 10*a*, 10*b* and a washer-like end wall 10*c* which is integral with the upper end portions of the walls 10*a*, 10*b*. The chamber 10*d* between the walls 10*a*, 10*b* contributes to the heat-insulating effect of the section 10, the same as the chamber 10*e* between the inner cylindrical wall 10*a* and the core 8.

The selection of material for the first section including the flanges 6, 7 and core 8 and for the second section 10 will depend on the circumstances under which the assembly of FIG. 1 is put to use. All of the just mentioned parts may be made of a suitable metallic material. At least a portion of the second section 10 can consist of heat-insulating material.

The details of the pump 1 and/or motor 2 form no part of the present invention.

An important advantage of the improved thermal barrier 5 is that it consists of simple and relatively inexpensive components each of which can be readily tested, not only prior to initial assembly and use but also after shorter or longer intervals of use. Moreover, the improved thermal barrier renders it possible to establish a highly reliable seal between the pump casing 1*a* and the motor housing 2*a* by the provision of discrete first and second sections the former of which can be designed, either primarily or expressly, to perform a satisfactory sealing function. On the other hand, the function of transmitting stresses between the casing 1*a* and the housing 2*a* is taken over by the discrete second section. In other words, each of the two sections performs a given function and, therefore, the sections can be designed with a view to ensure that they are particularly suited to perform the respective functions. This brings about the additional advantage that the thermal barrier can be assembled of discrete sections each of which is relatively simple and compact and each of which can be examined and tested much more readily than heretofore known thermal barriers wherein the components which take up mechanical stresses are normally integrated into the components (or constitute the components) performing the sealing action. Each and every portion of each of the two sections of the improved thermal barrier is readily accessible for testing by relatively simple testing instrumentalities which need not be designed for the express purpose of testing the section including the parts 6–8 or the section 10.

Furthermore, if the persons in charge decide that the anticipated mechanical stresses upon the thermal barrier are of such nature and/or magnitude that the section 10 then in use must or is preferably replaced by a sturdier section, the replacement of section 10 presents no serious problems and can be completed within a short interval of time. In other words, the improved thermal barrier can be readily modified so as to meet the anticipated requirements regarding the sealing action, the transmission of stresses, the resistance to mechanical stresses and/or several of these factors.

The thermal barrier 5 of FIG. 1 exhibits the additional advantage that its first section including the flanges 6, 7 and core 8 need not be assembled of rigidly connected components. This is of importance when the temperature of liquid in the pump casing 1*a* is much higher than the permissible temperature of liquid in the motor housing 2*a*. Under such operating conditions, expansion of the flange 6 under the action of heat is likely to be much more pronounced than that of the flange 7, and the expansion of the core 8 may vary from the one toward the other axial end thereof. By providing relatively simple connections between the parts 6, 7 and 8, one can readily compensate for such differences in thermally induced expansion. Moreover, one can employ relatively simple and inexpensive seals (9) between the internal surfaces of the flanges 6, 7 and the end portions of the core 8.

Figure 2:
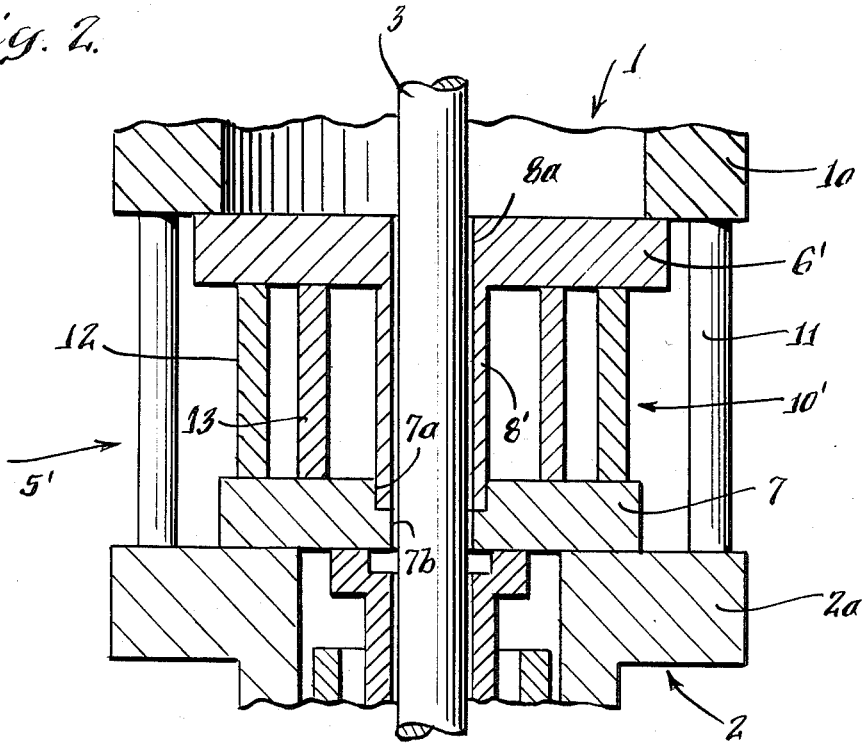
FIG. 2 is a fragmentary axial sectional view of a pump and motor assembly with a second thermal barrier.

FIG. 2 illustrates a second thermal barrier 5' which is installed between the casing 1*a* of a centrifugal pump 1 and the housing 2*a* of a motor 2. The first section of the thermal barrier 5' comprises a discrete flange 7, a second flange 6' and a hollow cylindrical core 8' which is integral with the flange 6' and the lower end portion of which extends into a recess 7*a* machined into the internal surface 7*b* of the flange 7. The depth of the recess 7*a*, as considered in the axial direction of the pump shaft 3, is less than the thickness of the flange 7.

The second section 10' of the thermal barrier 5' comprises several (e.g., two) coaxial or substantially coaxial cylindrical components or walls 12, 13 each of which can consist of two or more shells so that it can be readily assembled or taken apart. The end faces of the walls 12 and 13 are urged against the adjacent surfaces of the flanges 6' and 7 by the tie rods 11 which constitute a means for directly coupling the pump casing 1*a* to the motor housing 2*a*. The flange 7 can be said to constitute an apertured cover for the motor housing 2*a*. The core 8' is coaxial with the walls 12 and 13.

The thermal barrier 5' of FIG. 2 exhibits the advantage that the section which serves to prevent penetration of liquid from the exterior of the assembly into the clearance 8a and thence into the motor housing 2a comprises a relatively small number of component parts. Thus the portion 6' of the first section is integral with the portion 8', and the portion 8' may be integral with or separably connected to the portion 7. If the connection between the portions 7 and 8' comprises one or more welded seams, such seams can be readily inspected and tested by resorting to simple and available testing equipment. The welded seams can be provided in regions which are remote from regions that develop pressure peaks when the assembly utilizing the thermal barrier 5' is in operation so that such seams can stand long periods of use.

Figure 3:
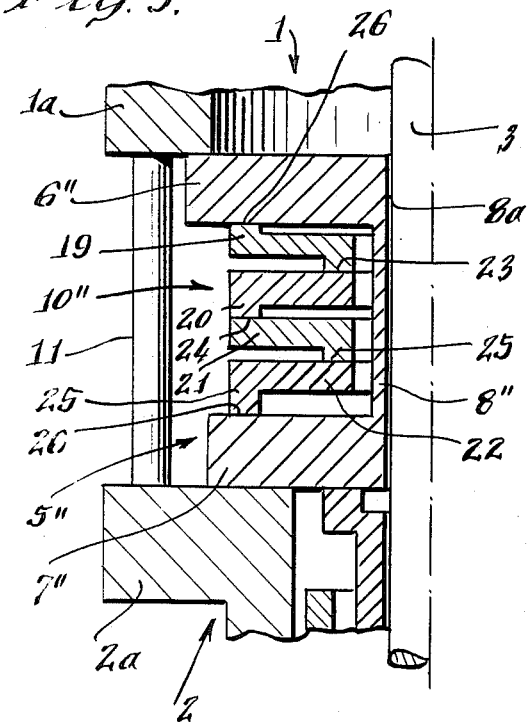
FIG. 3 is a fragmentary axial sectiOnal view of a pump and motor assembly which includes a third thermal barrier.

FIG. 3 illustrates a third thermal barrier 5'' which is interposed between the casing 1a of a centrifugal pump 1 and the housing 2a of an electric motor 2. The first section of the thermal barrier 5'' comprises an upper flange 6'' which is integral with the upper end portion of the core 8'' and a lower flange 7'' which is integral with the lower end portion of the core 8''. Thus, the portions 6'', 7'' and 8'' can be said to constitute a one-piece reel or spool which surrounds the pump shaft 3 with the clearance 8a.

The second section 10'' of the thermal barrier 5'' resembles a bellows which is assembled of several (e.g., four) coaxial ring-shaped portions or elements 19, 20, 21 and 22. Otherwise stated, it can be said that the second section 10'' has a meandering shape with surfaces whose area greatly exceeds that of the surfaces of the second section 10' or 10. The neighboring ring-shaped portions or elements 19–20, 20–21 and 21–22 have abutting surfaces 23, 24 and 25 which are respectively nearer to, more distant from and nearer to the shaft 3 and core 8''. In other words, the locations of abutment between successive ring-shaped portions of the section 10'' alternate, as considered in the radial direction of the thermal barrier 5''. Each of the portions 19–22 can be rigid with the adjacent portion, and each such portion can consist of two or more arcuate parts so that the section 10'' can be rapidly taken apart upon loosening and removal of at least some tie rods 11 which serve to establish a direct connection between the casing 1a and the housing 2a and cause the flanges 6'' and 7'' to bear against the adjacent surfaces 26 of the respective ring-shaped portions 19 and 22. It is clear that the outer section 10'' can be assembled of fewer or more than four ring-shaped portions or elements and that the wall thicknesses of these portions need not be the same. An advantage of the bellows-shaped envelope or section 10'' is that it establishes a relatively long (meandering) path for the transfer of heat from the flange 6'' toward the flange 7'', i.e., from the casing 1a toward the housing 2a.

Figure 4:
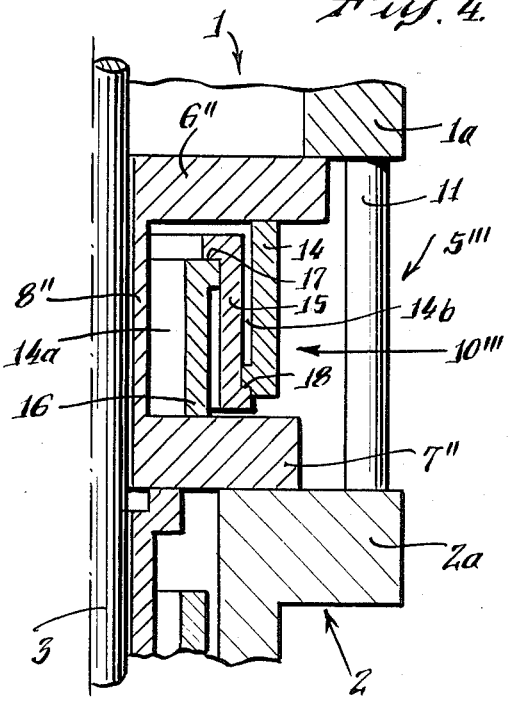
FIG. 4 is a similar fragmentary axial sectional view of an assembly with a thermal barrier constituting a modification of the thermal barrier shown in FIG. 3.

FIG. 4 shows a thermal barrier 5''' which is similar to the thermal barrier 5'' of FIG. 3 and has an identical first section consisting of two flanges 6'' and 7'' as well as a core 8'' whose end portions are integral with the respective flanges. The second section 10''' of the thermal barrier 5''' shown in FIG. 4 consists of several cylindrical portions or walls 14, 15 and 16 which can be said to be telescoped into each other so as to form a functional equivalent of the bellows-shaped section 10'' shown in FIG. 3. The main difference is that the abutting surfaces 17, 18 between the neighboring walls 14–15 and 15–16 are spaced apart from each other as considered in the axial (rather than radial) direction of the shaft 3. In other words, the abutting surfaces 17 of the inner wall 16 and intermediate wall 15 are nearer to the flange 6'' and the abutting surfaces 18 of the intermediate wall 15 and outer wall 14 are nearer to the flange 7'' of FIG. 4. The section 10''' of FIG. 4 also provides a relatively long path for the transfer of heat from the region of contact between the flange 6'' and the wall 14 to the region of contact between the flange 7'' and the wall 16. Each of the walls 14 to 16 can be assembled of several shells to allow for rapid removal of the section 10''' from the space within the confines of the annulus of the rods 11. These tie rods connect the casing 1a of the pump 1 with the housing 2a of the motor 2. The surfaces 17 and 18 can be bonded, welded or otherwise connected to each other, depending on the nature of the material of which the walls or portions 14 to 16 are made.

The core 8'' of FIG. 4 defines with the section 10''' a first annular chamber 14a, and the walls 15, 16 define a second annular chamber 14b which communicates with the space around the section 10'''.

Figure 5:
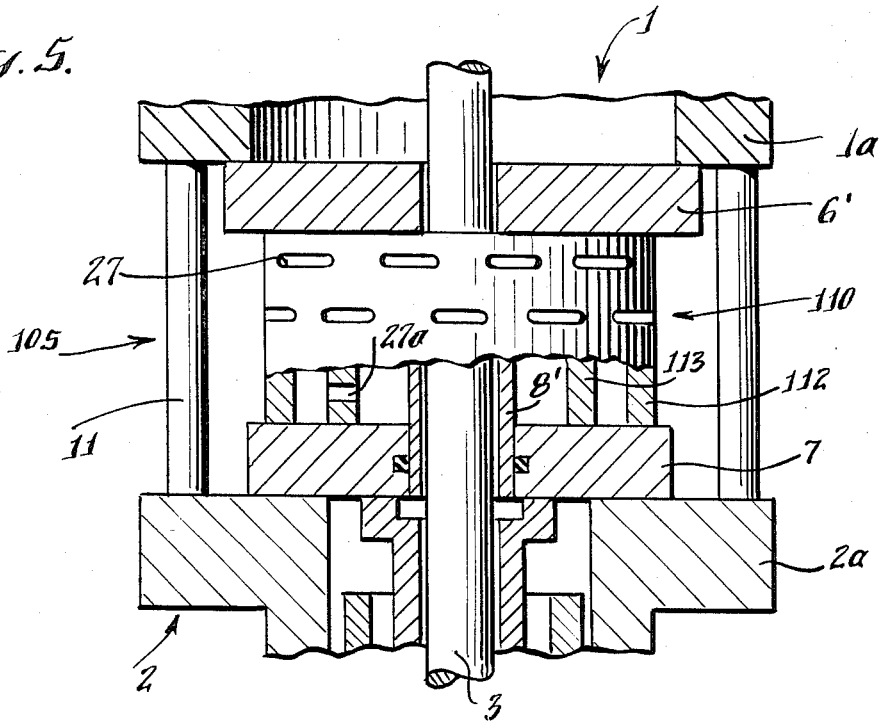
FIG. 5 is a fragmentary partly elevational and partly axial sectional view of a pump and motor assembly with a fifth thermal barrier.

FIG. 5 illustrates a thermal barrier 105 which is installed between the casing 1a of a pump 1 and the housing 2a of a motor 2. The thermal barrier 105 is similar that which is shown in FIG. 2 except that the outer tubular element or cylindrical wall 112 of the section 110 has a plurality of apertures in the form of elongated slots 27 extending in the circumferential direction of the wall 112 and forming several rows with the slots of neighboring rows staggered with reference to each other, again as considered in the circumferential direction of the wall 112.

The inner tubular element or cylindrical wall 113 of the section 110 shown in FIG. 5 can also comprise one or more rows of apertures in the form of slots, cylindrical bores or the like. One such aperture is shown at 27a.

The purpose of the apertures 27 and 27a is to prolong the paths for the transfer of heat from the flange 6' toward the flange 7 of the section 110. The manner in which the tie rods 11 cause the flanges 6' and 7 to bear against the adjacent end faces of the cylindrical walls 112 and 113 is the same as described in connection with FIGS. 1 and 2.

Figure 6:
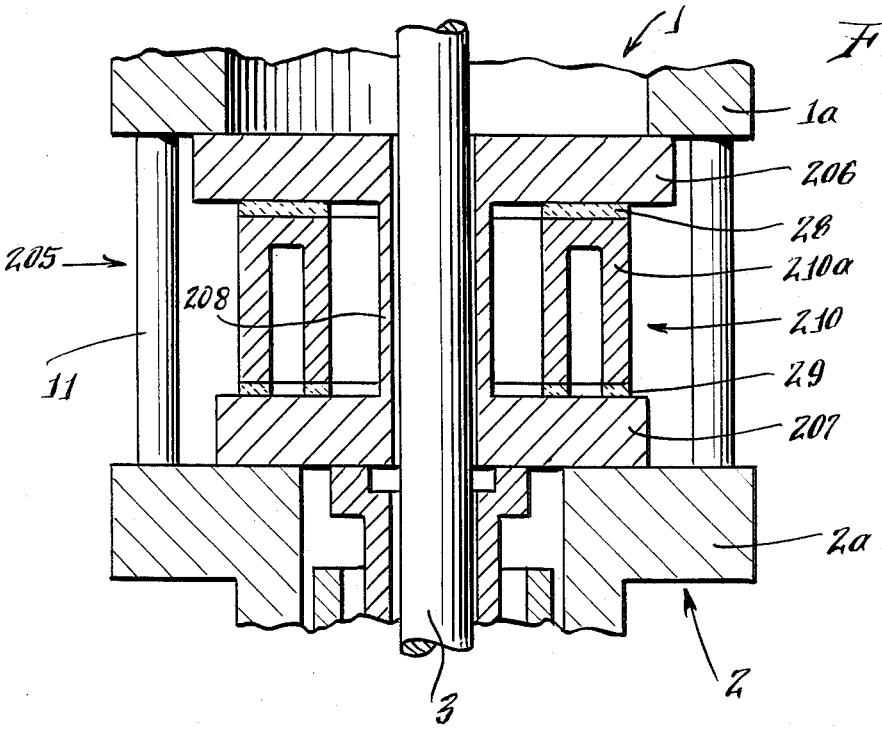
FIG. 6 is a fragmentary axial sectional view of a pump and motor assembly with a sixth thermal barrier.

Referring to FIG. 6, there is shown a thermal barrier 205 having a first section including a flange 206 integral with the upper end portion of the core 208 and a flange 207 integral with or seperably connected to the lower end portion of the core 208. The second section 210 of the thermal barrier 205 includes a twin-walled cylindrical member 210a which is similar to or identical with the member of FIG. 1 including the walls 10a, 10b and 10c. In addition, the thermal barrier 205 of FIG. 6 comprises heat-blocking or insulating means interposed between the axial ends of the twin-walled member 210a and the flanges 206 and 207. There is a washer-like annular thermally insulating element or layer 28 which is interposed between the member 210a and the adjacent surface of the flange 206, as well as a pair of ring-shaped insulating layers 29 interposed between the upper side of the flange 207 and the lower end face of the member 210a. The material of the layers 28, 29 can be any one of a variety of suitable heat-insulating substances. The layers 28 and/or 29 can be relatively thick or relatively thin, as considered in the axial direction of the pump shaft 3, depending on the desired thermally insulating properties of these layers. In many instances, the layers 28 and/or 29 may constitute films of strongly heat-resistant and heat-insulating material which are applied to the respective surfaces of the flanges 206, 207 and/or to the respective surfaces or end faces of the member 210*a*.

Figure 7:
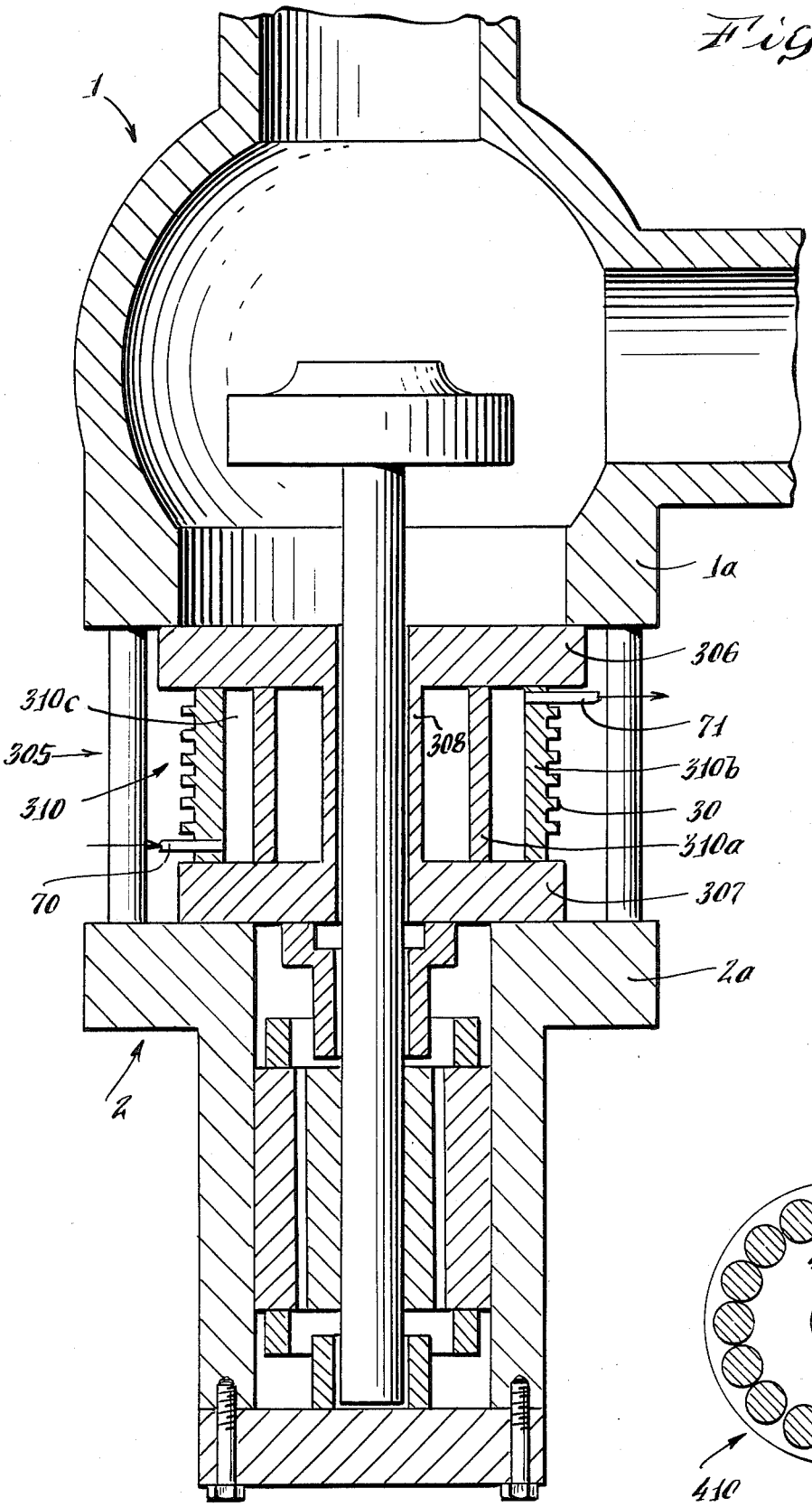
FIG. 7 is a somewhat schematic axial sectional view of a glandless pump and motor assembly which embodies a further thermal barrier.

FIG. 7 shows a further thermal barrier 305 having a first section including two coaxial flanges 306, 307 which are integral with the respective end portions of the core 308, and a second section 310 having an inner cylindrical wall 310*a* and an outer cylindrical wall 310*b*. The outer cylindrical wall 310*b* is formed with a set of unevennesses in the form of annular projections 30 which are provided at its external surface and can be said to constitute ribs extending all the way around the wall 310*b*. The purpose of the ribs 30 is to increase the area of the external surface of the wall 310*b* so that the latter is less likely to allow the transfer of a substantial amount of heat from the flange 306 toward the flange 307. If desired, the inner side of the wall 310*b*, the outer side of the wall 310*a* and/or the inner side of the wall 310*a* can also be provided with surface- or area-increasing projections in the form of discrete studs, circumferentially extending ribs, rings, polygonal protuberances or a combination of these.

The feature (projections 30) of the thermal barrier 305 of FIG. 7 can be utilized with equal advantage in the previously described embodiments of the improved thermal barrier. By the same token, some or all of the features of the thermal barriers shown in the FIGS. 1–6 can be utilized in the thermal barrier 305, the features of the thermal barriers shown in FIGS. 1–4 and 6–7 can be used in the thermal barrier of FIG. 5, the features of the thermal barriers shown in FIGS. 1–3 and 5–6 can be used in the thermal barrier of FIG. 4, and so forth.

Figure 8:
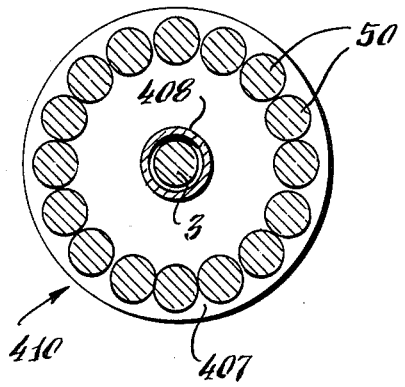
FIG. 8 is a horizontal sectional view of a portion of an additional thermal barrier.

The configuration of the component parts or elements of the second section of the improved thermal barrier will depend on the anticipated thermal and/or mechanical stressing of the thermal barrier. As shown, the elements or component parts of the second section may constitute or resemble cylindrical walls, annuli, washers or the like. It is equally possible to utilize a second section which is assembled, entirely or in part, of rods, bars, ribs, tubes, strips or analogous elongated elements together forming one or more substantially cylindrical or tubular shields around the core of the first section. By way of example, FIG. 8 shows a second section 410 which is assembled of an annulus of closely adjacent bars or ribs 50 together forming a tubular shroud around the core 408 of the first section. The end portions of the elongated elements 50 abut against the respective flanges (see the flange 407) of the first section.

The component parts of the second section will be selected with a view to produce a satisfactory heat insulating and heat radiating action, to prolong the path for the transfer of heat between the pump and the motor, and to take up all or nearly all stresses which develop when the thermal barrier is in use so that such stresses need not be taken up by the first section. As shown in FIGS. 3 and 4, the axial length of the second section 10″ or 10‴ need not be excessive even though the elements (19–22 or 14–16) of the second section provide relatively long paths for the transfer of heat from the upper flange to the lower flange of the respective first section. A further important and desirable function of the second section in each and every embodiment of the improved thermal barrier is that it is capable of taking up the mechanical stresses in such a way that the pump shaft 3 is invariably protected against pronounced bending or flexing stresses. This renders it possible to utilize a lightweight shaft whose dimensions are selected primarily with a view to ensure adequate transmission of torque to the impeller or impellers of the pump 1.

The improved thermal barrier is susceptible of many additional modifications without departing from the spirit of the invention. For example, one or more chambers which are defined by the thermal barrier can be filled with heat-insulating material. This is shown in FIG. 1 wherein the chamber 10d is filled with a body 60 of heat-insulating material. Furthermore, one or more component parts of the first and/or second section of the thermal barrier may consist, either entirely or in part, of heat-insulating material. For example, the inner cylindrical wall 13 shown in FIG. 2 may consist of a suitable heat-insulating material, namely, a material whose heat-insulating properties are much more pronounced than those of the parts 12, 6′, 8′ and 7.

FIG. 7 shows an outer chamber 310*c* which can be connected with means for circulating a gaseous or liquid coolant therethrough. Such circulating means includes a fluid admitting pipe 70 and a fluid discharging pipe 71.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A glandless circulating pump and motor assembly comprising: (a) a pump having a casing; (b) a motor having a housing which is spaced from said casing; (c) a pump shaft connected with said pump and said motor; and (d) a thermal barrier interposed between said casing and said housing, said barrier including a first section through which said shaft passes with clearance, and said first section having first and second portions which form respective seals with said casing and said housing, and a third portion which connects and is sealed to said first and second portions, said barrier further including a removably installed second section comprising a plurality of separable components, said second section being interposed between said first and second portions and at least partly surrounding said third portion, said second section being removable from between said first and second portions and being designed to impede heat transfer and transmit stresses between said casing and said housing.

2. The assembly of claim 1, wherein said second section comprises a plurality of separable components.

3. The assembly of claim 1, wherein said third portion is separably connected with at least one of said first and second portions of said first section.

4. The assembly of claim 1, wherein said third portion is integral with at least one of said first and second portions of said first section.

5. The assembly of claim 1, wherein said first section is a reel having two flanges constituted by said first and second portions and a core constituted by said third portion.

6. The assembly of claim 1, wherein said second section includes an annulus of discrete elongated elements, said annulus spacedly surrounding said third portion intermediate said first and second portions of said first section.

7. The assembly of claim 6, wherein said elongated elements are bars.

8. The assembly of claim 1, wherein said second section includes an annulus of discrete tubes, said annulus spacedly surrounding said third portion intermediate said first and second portions of said first section.

9. The assembly of claim 1, wherein said second section includes an annulus of discrete ribs, said annulus spacedly surrounding said third portion intermediate said first and second portions of said first section.

10. The assembly of claim 1, wherein said second section includes a plurality of tubular components including an inner tubular component spacedly surrounding said third portion of said first section and an outer tubular component spacedly surrounding said inner tubular component.

11. The assembly of claim 10, wherein said tubular components are cylindrical walls and said third portion is a hollow cylindrical core coaxial with said walls.

12. The assembly of claim 1, wherein said second section comprises a series of neighboring coaxial ring-shaped elements together constituting a substantially bellows-shaped envelope spacedly surrounding said third portion intermediate said first and second portions of said first section.

13. The assembly of claim 12, wherein said annular elements constitute several successive pairs of neighboring elements having abutting surfaces and the abutting surfaces of successive neighboring elements are alternately nearer to and more distant from said third portion of said first section.

14. The assembly of claim 1, wherein said second section comprises a plurality of coaxial cylindrical walls which are telescoped into each other.

15. The assembly of claim 14, wherein said walls include an inner wall, an intermediate wall and an outer wall, said intermediate wall abutting against said outer wall nearer to one of said first and second portions and against said inner wall nearer to the other of said first and second portions of said first section.

16. The assembly of claim 1, wherein said second section comprises at least one tubular element spacedly surrounding said third portion and having a plurality of apertures therein.

17. The assembly of claim 16, wherein said apertures are distributed in several rows, as considered circumferentially of said tubular element, and the apertures of neighboring rows are staggered with reference to each other, as considered in the circumferential direction of said element.

18. The assembly of claim 1, wherein said second section includes a plurality of elements which define at least one chamber with each other and with said portions of said first section.

19. The assembly of claim 18, further comprising a body of heat-insulating material in said chamber.

20. The assembly of claim 1, wherein at least a portion of said second section consists of heat-insulating material.

21. The assembly of claim 1, wherein said second section includes at least one element surrounding said third portion and at least one layer of heat-insulating material on said element.

22. The assembly of claim 1, further comprising a body of heat-insulating material interposed between said second section and at least one of said first and second portions of said first section.

23. The assembly of claim 1, wherein said second section defines at least one chamber; and further comprising means for circulating a fluid coolant through said chamber.

24. The assembly of claim 1, wherein said second section has at least one surface provided with unevennesses as to increase the area of such surface.

25. The assembly of claim 24, wherein said unevennesses include projections.

26. The assembly of claim 25, wherein said projections include ribs.

* * * * *